US007432480B2

(12) United States Patent
Wilson et al.

(10) Patent No.: US 7,432,480 B2
(45) Date of Patent: Oct. 7, 2008

(54) INDUCTION DRYER

(75) Inventors: Timothy E. Wilson, Wakeman, OH (US); Howard Podolny, Medina, OH (US); Raymond J. Baxter, Vermilion, OH (US)

(73) Assignee: Nordson Corporation, Westlake, OH (US)

( * ) Notice: Subject to any disclaimer, the term of this patent is extended or adjusted under 35 U.S.C. 154(b) by 127 days.

(21) Appl. No.: 10/527,860

(22) PCT Filed: Dec. 9, 2003

(86) PCT No.: PCT/US03/38942

§ 371 (c)(1),
(2), (4) Date: Nov. 7, 2005

(87) PCT Pub. No.: WO2004/054323

PCT Pub. Date: Jun. 24, 2004

(65) Prior Publication Data

US 2006/0151479 A1 Jul. 13, 2006

Related U.S. Application Data

(60) Provisional application No. 60/431,938, filed on Dec. 9, 2002.

(51) Int. Cl.
*H05B 6/02* (2006.01)
*H05B 6/10* (2006.01)

(52) U.S. Cl. ..... 219/629; 219/629; 219/635

(58) Field of Classification Search ..... 219/730, 219/728, 729, 731, 734, 745, 727, 759; 428/138, 428/182, 35.2, 323, 34.3, 537.5, 344, 461, 428/345, 349, 255.1; 426/107, 109, 234, 426/241, 243; 99/DIG. 14; 373/157
See application file for complete search history.

(56) References Cited

U.S. PATENT DOCUMENTS 3,912,846 A * 10/1975 Yamagishi et al. ..... 373/6
5,483,042 A 1/1996 Sprenger et al.
5,529,703 A 6/1996 Sprenger et al.
5,821,504 A 10/1998 Sprenger et al.
5,970,083 A * 10/1999 Orcel et al. ..... 373/157

OTHER PUBLICATIONS

"Mountaingate ICD Series Induction Dryers", Customer Product Manual Part 1018438A, Issued Feb. 2002, Nordson Corporation, 33 pgs.

(Continued)

*Primary Examiner*—Quang T Van
(74) *Attorney, Agent, or Firm*—Calfee, Halter & Griswold LLP

(57) ABSTRACT

In an induction heater, preheated, pressurized air is further heated in the heating cabinet and also drawn into the coil tube via a suction fan. The simultaneous pulling and pushing of the twice-heated air through the tube provides superior air flow to pick up more moisture from the can ends being dried. The tube ends rest on upwardly concave collars and are held in place by gravity, with a single screw acting as a stop above to prevent upward movement. Removal requires only removing the single screw at each end then lifting the tube straight up out of the cabinet, which is facilitated by providing a hinged cover on the cabinet.

20 Claims, 4 Drawing Sheets

OTHER PUBLICATIONS

"Nordson EcoDry Series Induction Dryers", Customer Product Manual Part 1045354A, Issued Oct. 2003, Nordson Corporation, 34 pgs.

Nordson Corporation drawing, MG 3555, Side View ICD-4S Induction Dryer, Nov. 28, 2007, 1 page.

Nordson Corporation drawing, 381093, Sensor, Thermo Assembly, Mar. 31, 2000, 1 page.

* cited by examiner

INDUCTION DRYER

CROSS-REFERENCE TO RELATED APPLICATIONS

This application claims priority to prior International Application Serial No. PCT/US03/038942, filed Dec. 9, 2003 for INDUCTION DRYER which claims the benefit of U.S. Provisional Patent Application Ser. No. 60/431,938, filed on Dec. 9, 2002 for LOW COST END DRYER.

BACKGROUND OF THE INVENTION

The present invention relates to apparatus and methods for heating and, thereby, drying, a plurality of plate-like metal objects such as metal can lids, also known as "closures" or "ends".

Closures for metal beverage containers are generally of a circular shape with a flanged perimeter called a curl. The closures may also be of a rectangular shape. The closures are usually made of aluminum or steel, and the curl is used in attaching the closure to a can body through a seaming operation. To aid the integrity of the seal that is formed between the can body and the closure, it is a common practice to apply a bead of sealant or adhesive ("compound") within the curl of the can end during manufacture of the closure. Different types of coatings are also selectively or generally applied to can closures and can bodies for various other purposes as well, for example, to repair damaged coatings. For the purposes of the present description, coatings, sealants and adhesives are all considered to be "liquids" applied to a workpiece.

It is necessary in this manufacturing operation to cure or dry such liquids. It is known to dry can closures by infrared radiation, convection heating, or induction heating. An induction dryer, for example, typically includes a cabinet that supports a tube extending generally horizontally across the cabinet from one end to the other. The tube is larger in diameter than the can ends. An induction coil is wrapped around the tube. The ends move through the tube in a stacked relationship, that is, with abutting face-to-face contact with each other ("in-stick"). When a suitable electric current is passed through the coil, the metal can ends are inductively heated. The heat is transferred to the compound on the can ends by conduction from the heated metal. The compound is heated and water is driven off from the compound into the surrounding air.

Because of the close proximity of one end to another in the stick, it is desirable to have as much warm air as possible contact the ends, while they are in the dryer, to remove the water from the area around the can ends. In one prior art induction dryer, air is heated with an ambient air heater that is mounted externally to the cabinet, for example, on top of the cabinet. The air flows from the heater along a flexible external duct and is directed into an air box secured on the inlet wall of the cabinet, surrounding the inlet opening into the tube. Some of the air flows from the air box to atmosphere through an opening in the air box that admits the moving can ends from an external source. The remainder of the heated air flows from the air box into the tube, flowing in the direction of the moving can ends. The air that is forced into the tube flows out the outlet end of the tube at the opposite end wall of the cabinet, under the force of the air being forced in at the inlet end. The flow of heated air through the tube helps to remove the moisture that is driven off from the heated can ends in the tube, and thus promotes drying of the ends.

In the prior art induction dryer, a thermocouple is located at the outlet end of the tube. The thermocouple is mounted in the end wall of the cabinet, at the circumferential top of the outlet opening. As the can ends pass through the outlet opening, the thermocouple registers the temperature of the can ends. The thermocouple provides an electric output that is used by a controller for the dryer to help control the current in the induction coil and/or other factors in the heating apparatus.

The thermocouple is adjusted to touch the can ends. This engagement of the thermocouple with the can ends can create a jam point if the ends are not in perfect stick form. Also, the thermocouple bracket is subject to deformation which would move the thermocouple away from the stick, which would register a temperature fault, shutting down the system.

The stick is, preferably, constantly moving. However, jams may occur, or some other occurrence may prevent the can ends from moving smoothly through the dryer. The prior art dryer includes a wheel that is mounted at the inlet end of the dryer and that contacts the upper edges of the moving can ends. If the stick stops moving, the wheel stops rotating, and an appropriate output signal is provided to the controller for the dryer, alerting it that the stick is not moving.

At times the induction coil tube needs to be removed from the cabinet, for example, for maintenance or to replace the tube with a different diameter tube more suitable for drying can ends of a different diameter. In the prior art dryer, the tube ends are held in place in the cabinet end walls with split collar hubs. Each upper hub is loosened by removing four screws. The upper hub can then be lifted upward a little and the tube can be pulled out of the cabinet through one end wall or the other of the cabinet. This process requires clearing away any equipment, such as an upstacker or a separator, from the end of the cabinet, to clear space for pulling out the entire tube, which may be four to eight feet in length.

SUMMARY OF THE INVENTION

The present invention relates to a heater for heating workpieces, such as can ends, to drive off moisture from a compound on the can ends. The invention is directed towards improving the design of induction heaters and to solve the problems described above.

A first aspect of this invention is to pressurize the air in the heating cabinet, and draw this air directly into the induction coil tube via a suction fan at the outlet end of the tube that draws the air in through the inlet end. The simultaneous pulling and pushing of the air through the tube provides superior air flow to pick up more moisture from the can ends being dried.

A second aspect of this invention is to preheat the air in the heating cabinet, preferably by using it to draw heat from power and control circuitry of the dryer. The preheated air is then heated again with an open coil heater than is located inside the heating cabinet adjacent to the inlet end of the tube. This double heating of the air helps to pick up more moisture from the can ends being dried.

A third aspect of the invention involves the relocation of a temperature-sensing thermocouple, at the outlet end of the tube, from the top of the tube to the bottom of the tube, where the moving can ends will ride directly over the thermocouple. This arrangement provides superior temperature sensing for controlling the heating process, in that the new location insures that the can ends ride centered on the sensor with pre-set tension.

A further aspect of the invention relates to replacing the rotary wheel motion sensor at the inlet end of the tube, used to sense whether the stick is moving or not, with a laser sensor. The laser sensor is more accurate and is less prone to jamming because it is non-contact (not touching the can ends) and h as no moving parts to wear or jam.

Yet another aspect of the invention relates to a new supporting system for the tube. The tube ends rest on upwardly concave collars and are held in place by gravity, with a single screw acting as a stop above to prevent upward movement. Removal requires only removing the single screw at each end then lifting the tube straight up out of the cabinet, which is facilitated by providing a hinged cover on the cabinet. This new mounting and retention mechanism provides for substantially easier removal of the tube, as is periodically needed during use and maintenance of the tube.

BRIEF DESCRIPTION OF THE DRAWINGS

The foregoing and other features of the present invention will become apparent to one skilled in the art to which the present invention relates upon consideration of the following description of the invention with reference to the accompanying drawings, in which.

DETAILED DESCRIPTION OF THE INVENTION

Figure 1:
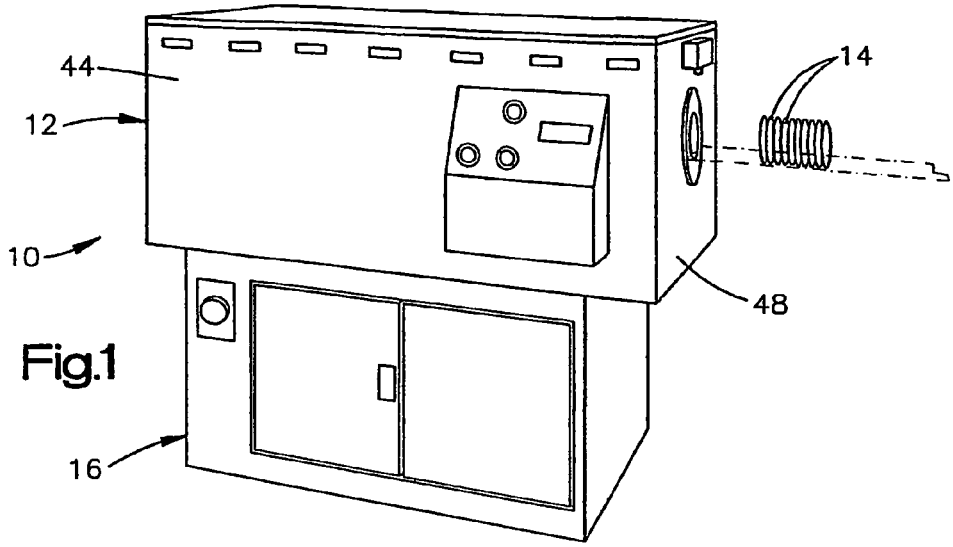
FIG. 1 is a pictorial view of a dryer that is one embodiment of the invention.
Figure 2:
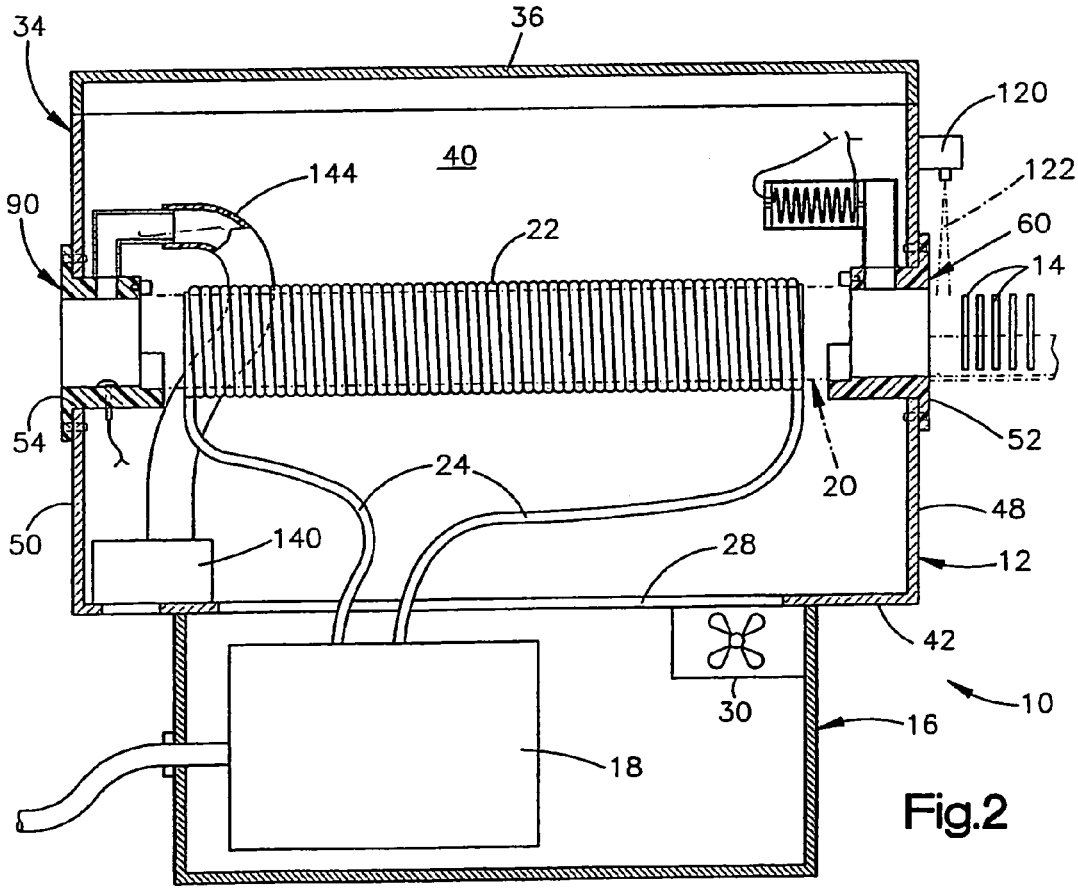
FIG. 2 is a schematic, longitudinal sectional view of the dryer of FIG. 1.
Figure 3:
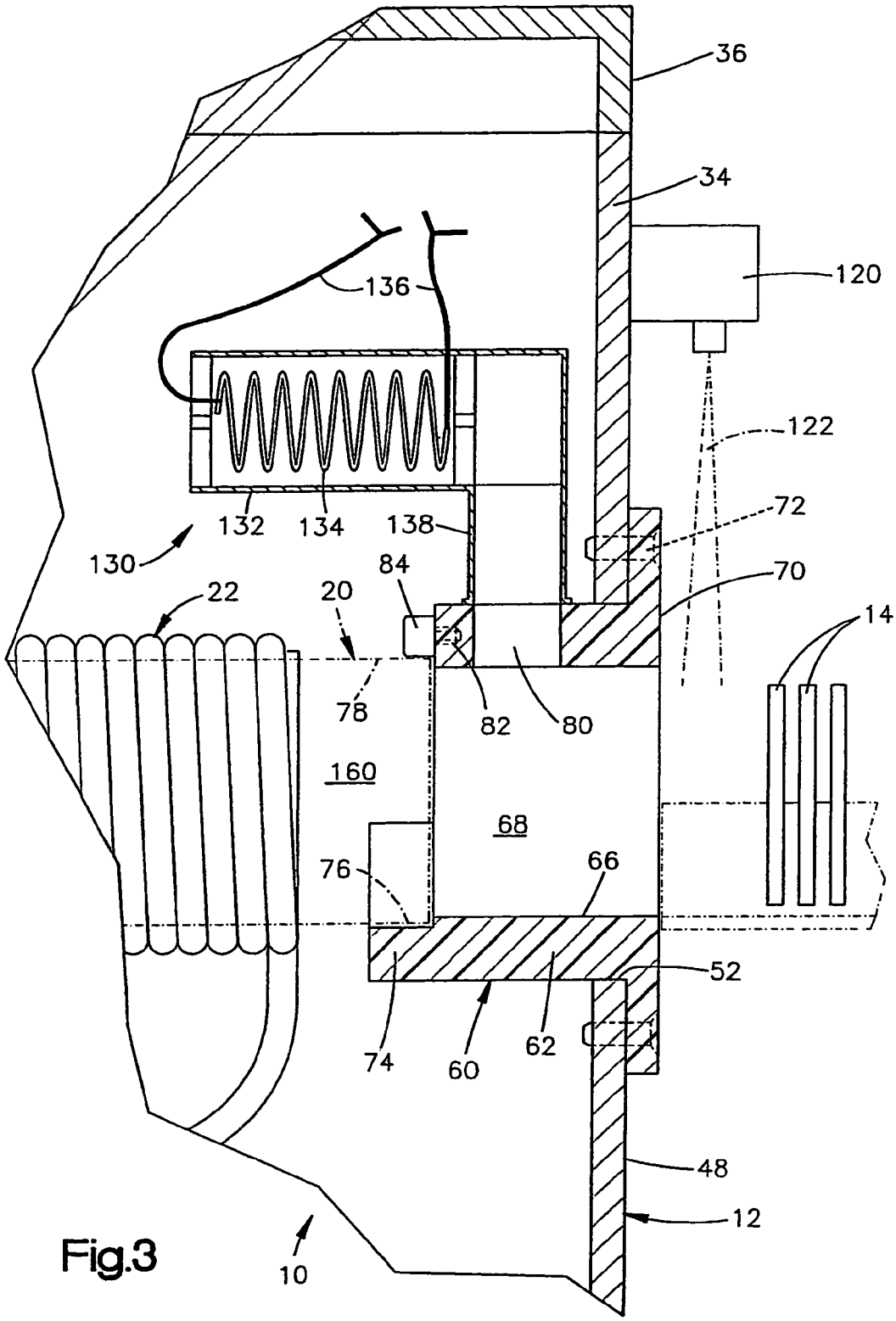
FIG. 3 is an enlarged sectional view of an inlet end of the dryer of FIG. 1.
Figure 6:
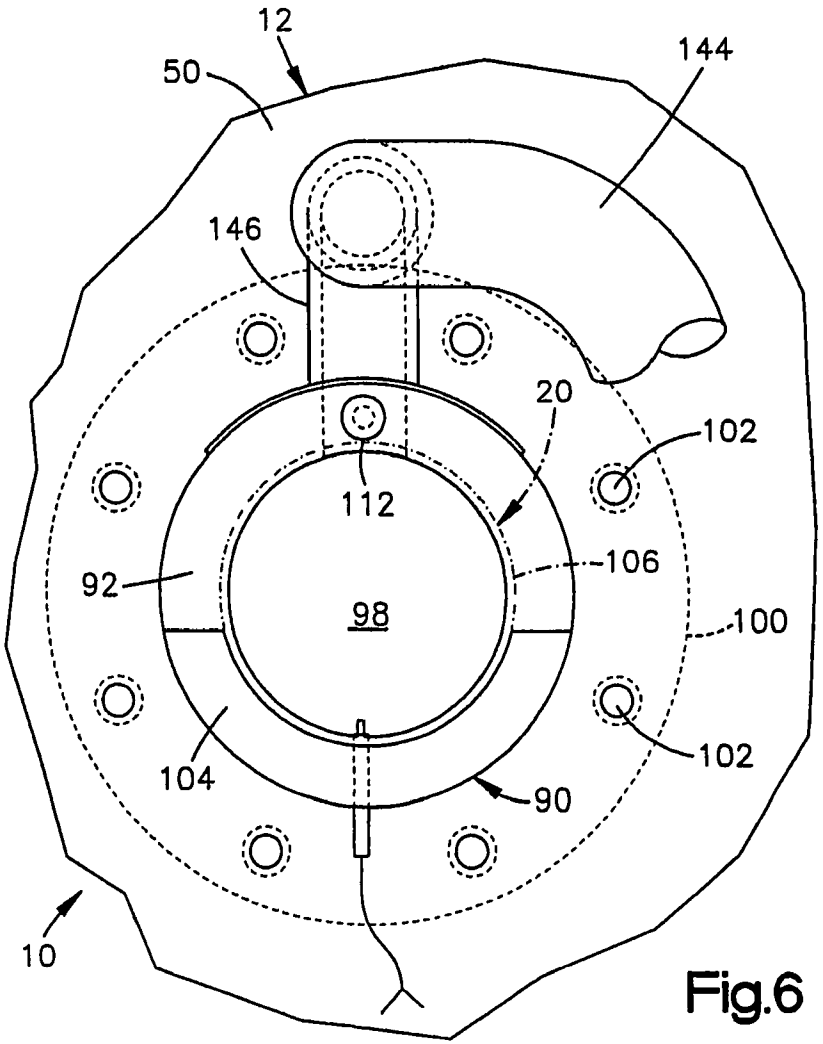
FIG. 6 is an interior elevational view of the outlet end of the dryer of FIG. 1.
Figure 4:
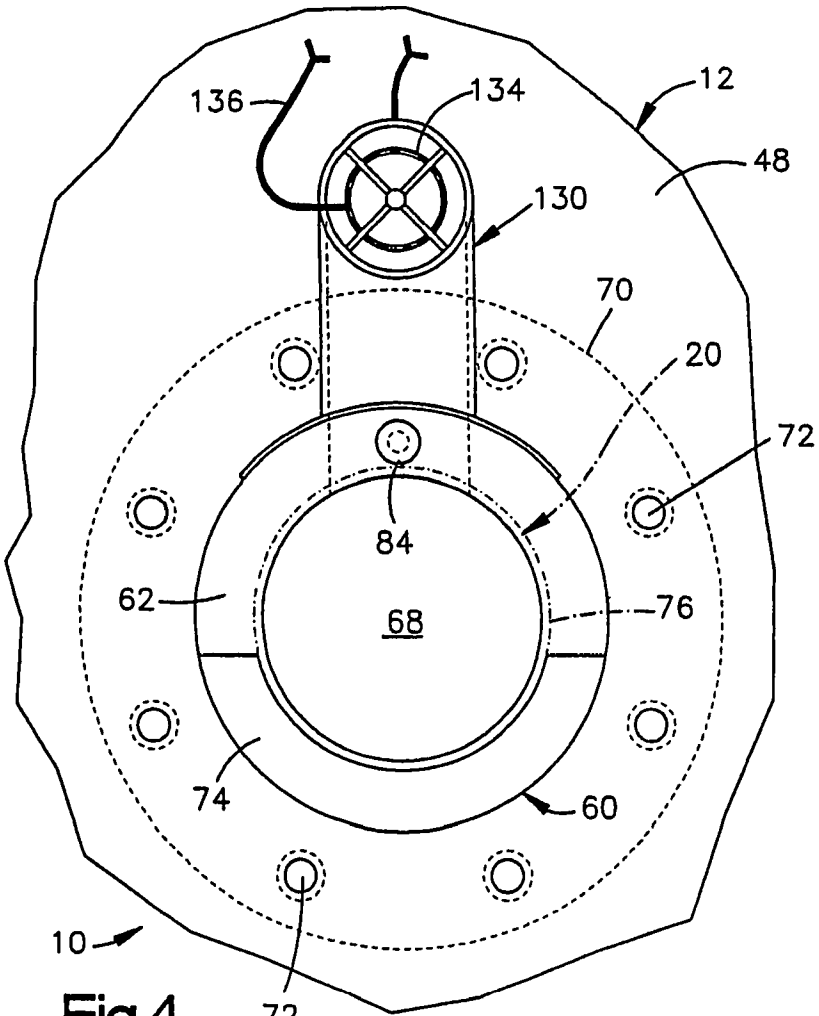
FIG. 4 is an interior elevational view of the inlet end of the dryer of FIG. 1.
Figure 5:
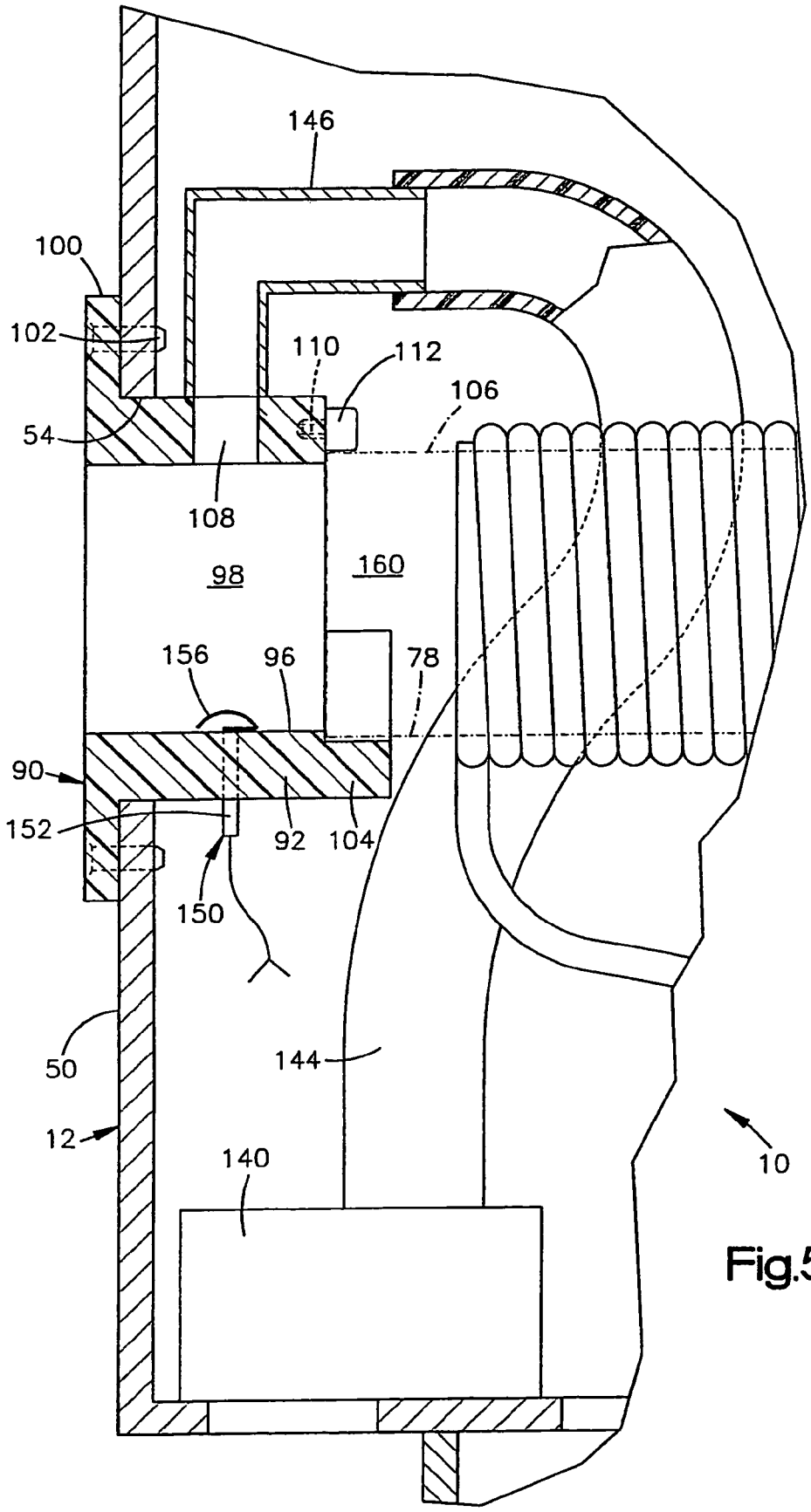
FIG. 5 is an enlarged sectional view of an outlet end of the dryer of FIG. 1.

The present invention relates to apparatus and methods for drying plate-like metal objects such as metal can lids or "ends". The invention is applicable to various apparatus and methods for drying such objects. AS representative of the invention, FIG. 1 illustrates a dryer 10 constructed in accordance with a first embodiment of the invention.

The dryer 10 includes a heating cabinet 12, through which workpieces such as can ends 14 pass to be heated and dried, and a power and control cabinet 16. The power and control cabinet 16 serves as a base for and supports the heating cabinet 12. The power and control cabinet 16 includes power and control circuitry indicated schematically at 18 which may include, for example, one or more transformers.

As described below in detail, the heating cabinet 12 supports a nonconductive tube 20 around which an induction coil 22 extends. The induction coil 22 is electrically connected with the power and control circuitry 18 by wires 24. Operation of the power and control circuitry 18 generates an electric current that flows through the induction coil 22 to heat any conductive material located within the tube 20. Thus, steel or aluminum ends can be heated.

Operation of the power and control circuitry 18 also generates heat which flows upwardly through one or more vents openings 28 into the heating cabinet 12. A fan 30 in the power and control cabinet 16 pulls ambient air into the power and control cabinet to cool the equipment 18 therein. The heated air flows over a heat sink then, with some residual heat still in it, exits the power and control cabinet 16 into the heating cabinet 12, through one or more of the vent openings 28.

The heating cabinet 12 includes a cabinet base 34 and a lid 36. The lid 36 is movable relative to the base 34. The lid 36 is preferably hinged to the base 34 at the back edge of the lid, so that it may be lifted open. When the lid 36 is lifted open or removed, the interior of the heating cabinet 12 is accessible from above, to enable removal of the tube 20, as described below.

The cabinet base 34 includes a plurality of walls that define a heating chamber 40 in the cabinet. The walls include a bottom wall 42 (FIG. 2); a front wall 44 (FIG. 1); an opposite back wall (not shown); an inlet end wall 48, and an outlet end wall 50 (FIGS. 2-6). When the dryer 10 is in operation as described below, can ends 14 move into the dryer through an opening 52 in the inlet end wall 48, and exit the dryer through an opening 54 in the outlet end wall 50.

The inlet end wall 48 of the cabinet 12 supports an inlet hub 66. The inlet hub 60 in the illustrated embodiment is a molded plastic member having a cylindrical main body portion 62. The outer diameter of the main body portion 62 is selected to fit within the opening 52 in the inlet end wall 48 of the heating cabinet 12. The main body portion 62 has a cylindrical inner surface 66 that defines a cylindrical passage 68 extending through the hub 60. The size of the passage 68 is selected to accommodate can ends 14 to be dried in the dryer 10.

An annular mounting flange 70 of the inlet hub 60 extends radially outward from the main body portion 62. The mounting flange 70 is secured by fasteners shown schematically at 72 to the inlet end wall 48 of the cabinet 12. As a result, the inlet hub 60 is secured to the cabinet 12, with the main body portion 62 projecting into the interior of the cabinet 12 through the opening 52 in the inlet end wall 48 of the cabinet.

The inlet hub 60 includes a support ring 74. The support ring 74 extends inward from the main body portion 62 of the inlet hub 60. The support ring 74 has an arcuate configuration and is formed as a continuation of a lower circumferential sector of the main body portion 62. The inner diameter of the support ring 74 is substantially equal to the outer diameter of the tube 20. As a result, an inlet end 76 of the tube 20 can be supported on the support ring 74 so that the cylindrical inner surface 78 of the tube forms a continuation of the cylindrical inner surface 66 of the main body portion 62 of the inlet hub 60. Therefore, when a stick of can ends 14 moves into the dryer 10, it can slide smoothly from the main body portion 62 of the inlet hub 60 into the tube 20.

The main body portion 62 of the inlet hub 60 has a heater inlet opening 80 at or near the top. In addition, the main body portion 62 has an opening 82 for receiving a retainer or stop member 84, in the form of a stop screw, directly above the support ring 74.

Mounted in the exit opening 54 (FIG. 5) of the outlet end wall 50 of the heating cabinet 12 is an outlet hub 90 of the dryer 10. The outlet hub 90 is similar in configuration to the inlet hub 60. The outlet hub 90 is a molded plastic member having a cylindrical main body portion 92. The outer diameter of the main body portion 92 is selected to fit within the opening 54 in the outlet end wall 50 of the cabinet 12. The main body portion 92 has a cylindrical inner surface 96 that defines a cylindrical exit passage 98 extending through the hub 90. The size of the exit passage 98 is selected to accommodate can ends 14 to be dried in the dryer 10.

An annular mounting flange 100 of the outlet hub 90 extends radially outward from the main body portion 92. The mounting flange 100 is secured by fasteners shown schematically at 102 to the outlet end wall 50 of the cabinet 12. As a result, the outlet hub 90 is secured to the cabinet 12, with the main body portion 92 projecting into the interior of the cabinet through the opening 54 in the outlet end wall 50 of the cabinet.

The outlet hub 13 includes a support ring 104. The support ring 104 extends inward from the main body portion 92 of the outlet hub 90. The support ring 104 has an arcuate configuration and is formed as a continuation of a lower circumferential sector of the main body portion 92. The inner diameter of the support ring 104 is substantially equal to the outer diameter of the tube 20. As a result, an outlet end 106 of the tube 20 can be supported on the support ring 104 so that the cylindrical inner surface 28 of the tube forms a continuation of the cylindrical inner surface 96 of the main body portion 92 of the outlet hub 90. Therefore, when a stick of can ends 14 moves through the dryer 10, it can slide smoothly from the tube 20 onto the main body portion 92 of the outlet hub 90.

The main body portion 92 of the outlet hub 90 has an exhaust opening 108 at or near the top. In addition, the main body portion 92 has an opening 110 for receiving a retainer or stop member 112 in the form of a stop screw, directly above the support ring 104.

The inlet end wall 48 of the cabinet 12 supports a sensor 120, at a location above the inlet hub 60. The sensor 120 is operative to sense the presence or absence of movement of a stick of can ends 14 through the inlet hub 60.

In the illustrated embodiment, the sensor 120 is a non-contact sensor, preferably a laser sensor. The laser sensor 120 emits a laser beam, shown schematically at 122, that is directed toward the inlet opening of the inlet hub 60. The output of the laser sensor 120, in response, is used in controlling operation of the dryer 10, as described below.

The dryer 10 also includes a heater 130. The heater 130 is located inside the heating cabinet 12 and is supported on the inlet hub 60. The heater 130 is an electrically powered, open coil heater including a tubular main wall 132 within which are exposed electrical heating coils 134. The coils 134 are connected by lead wires 136 with a controllable source of electric current, such as the power and control circuitry 18.

The main wall 132 of the heater 130 is connected with an outlet wall 138 extending perpendicular to the main wall to form an L-shaped configuration for the heater. The outlet wall 138 is secured to the main body portion 62 of the inlet hub 60 in a manner that the heater interior communicates with the heater inlet opening 80 in the inlet hub.

The dryer 10 includes an exhaust blower or exhaust fan 140. The exhaust fan 140 is preferably located inside the heating cabinet 12 and, in the illustrated embodiment, is supported on the bottom wall 42 of the heating cabinet exhausting to an opening (not shown) in the back wall of the cabinet. A flexible duct 144 extends between the exhaust fan 140 and the exhaust opening 108 in the outlet hub 90. The duct 144 is connected with the outlet hub 90 by a rigid connector tube 146. The exhaust fan 140 is an electrically powered device that is operative to draw air from the interior of the outlet hub 90 and deliver it through the duct 144 to the opening in the back wall and thence to atmosphere, in a manner as described below.

A thermocouple 150 is located on the outlet hub 90. The thermocouple 150 has a body portion 156 disposed in an opening in the outlet hub 90. The thermocouple 150 has a sensor portion 156 that projects upward from the body portion 152, through a slot in the outlet hub 90, into the central passage 98 of the outlet hub. The sensor portion 156 of the thermocouple 150 is in the path of movement of the can ends 14 as they are pushed through the outlet hub 90 in a generally horizontal direction.

The tube 20 defines a generally enclosed space 160 in the heating cabinet 12, through which can ends 14 travel as they move through the dryer 12. The inlet end 76 of the tube 20 is supported on the inlet hub 50 for receiving workpieces. The inlet end 76 of the tube 20 enables air to flow into the enclosed space 160 inside the tube, from the interior of the heating cabinet 12.

The inlet end 76 of the tube 20 rests by gravity on the support ring 74 of the inlet hub 60. The retainer or stop member 84 is connected with the inlet hub 60, at a location opposite the support ring 74. In the illustrated embodiment, the retainer or stop member 84 is a nylon screw that is screwed into the opening 82 in the main body portion 62 of the inlet hub 60, at a location diametrically opposite the support ring 74 and at the top of the inlet end 76 of the tube 20. A different type of retainer or stop member 84 could be used.

When the screw 84 is in the opening 82, the screw blocks upward movement of the inlet end 76 of the tube 20 off the support ring 74 of the inlet hub 60. When the screw 84 is out of the opening 82, upward movement of the inlet end 76 of the tube 20, off the support ring 74 of the inlet hub 60, is not blocked, and the inlet end of the tube can be lifted upward.

In a similar manner, the outlet end 106 of the tube 20 rests by gravity on the support ring 104 of the outlet hub 90. The retainer or stop member 112 is connected with the outlet hub 90, at a location opposite the support ring 104. In the illustrated embodiment, the retainer or stop member 112 is a nylon screw that is screwed into the opening 110 in the main body portion 92 of the outlet hub 90, at a location diametrically opposite the support ring 104 and at above the outlet end 106 of the tube 20. A different type of retainer or stop member 112 could be used.

When the screw 112 is in the opening 110, the screw blocks upward movement of the outlet end 106 of the tube 20 off the support ring 104 of the outlet hub 90. When the screw 112 is out of the opening 110, upward movement of the outlet end 106 of the tube 20, off the support ring 104 of the outlet hub 90, is not blocked, and the outlet end of the tube can be lifted upward. As a result, removal of the tube 20 for maintenance and changing of tube sizes is very easy.

Can ends 14 to be dried are conveyed into the inlet passage 68 of the inlet hub 60 and thence into the inlet end 76 of the tube 20. The can ends 14 as they move through the tube 20 are acted upon by an alternating magnetic field generated by the induction coil 22. The can ends 14 are heated as a result, and this heat is conducted into the compound on the can ends. As the compound is heated, water is driven out of the compound into the surrounding air within the enclosed space 160 of the tube 20. This water is removed from the tube 20 as follows, to enable more can ends 14 to be dried within the tube.

The heater cabinet 12 is pressurized (above atmospheric) with heated air from the power and control cabinet 16. The fan 30 in the power and control cabinet 16 forces heated air from the power and control cabinet upward through the vent opening 28 in the bottom wall 42 of the heating cabinet 12. As a result, the air in the heating chamber 40 of the heating cabinet 12, surrounding the tube 20, is pressurized and heated to some extent.

The exhaust fan 140 in the heating cabinet 12 draws air from the outlet end 106 of the tube 20. This suction creates a flow of air through the tube 20 in a direction from the inlet end 76 of the tube to the outlet end 106 of the tube. As a result, air is drawn into the inlet end 76 of the tube 20, through the heater inlet opening 80, from the interior of the heating cabinet 12.

This effect is enhanced by the fact that the air in the heating cabinet 12 is already pressurized, to some extent, by the air flow from the fan 30 in the power and control cabinet 16. Thus, the air flowing into the inlet end 76 of the tube 20, and thence through the tube, is both pushed through the tube and pulled through the tube. This promotes a smoother and more effective flow of air through the tube 20.

The air that flows from the interior of the heating cabinet 12 into the tube 20 flows through the heater 130. As a result, this air passes over the exposed coils 134 of the heater 130. This second heating of the air provides an increased ability to draw moisture from the tube 20 as the heated air passes through the tube, as compared to the prior art dryer.

For example, air in the prior art dryer described above is typically heated to 40 degrees Celsius, while air with the present dryer 10 is heated to about 60 degrees Celsius. With the present invention, heating the preheated air from the interior of the heating cabinet 12 also produces hotter air than does the heating of ambient air. Because the air is heated twice, and to a higher temperature, is able to absorb more of the moisture in the enclosed space 160 that is driven off from the heated can ends 14. Although 60 degrees is the presently preferred temperature, it is possible to achieve some of the benefits of the heated air, at a reduced level, by heating the air to a temperature of at least 50 degrees Celsius. It is normally preferred that temperatures above about 65 degrees Celsius not be used because they can cause the compound on the can ends 14 to skin over, trapping water within the compound.

Because the heater 130 is located inside the cabinet 12, adjacent the inlet end 76 of the tube 20, the heated air from the heater is ducted directly into the inlet hub 60 and thence into the inlet end of the tube. This configuration minimizes the opportunity for heat loss that might otherwise occur through extensive ductwork or external ductwork or boxes, as in the prior art dryer.

It has also been found that the suction created by the exhaust blower 130, drawing the air through the tube 20, is preferable to forcing air in at the inlet end 76. Especially in combination with the flow of pressurized air into the heating cabinet 12 from the power and control cabinet 16, improved moisture removal is accomplished with the suction fan 130 as compared to the prior art dryer.

The can ends 14 slide along the inner surface 96 of the outlet hub 90 and engage the sensor portion 156 of the thermocouple 150 as they do so. The sensor portion 156 resiliently or deforms bends from the contact by the can ends 14. This direct contact of the can ends 14 with the thermocouple sensor 156 provides improved temperature sensing of the can ends, which always contact the thermocouple by gravity and provide a constant pressure due to design placement, as compared to the overhead sensing that was provided with the prior art dryer in which the thermocouple was subject to installation adjustment and product jams which alter sensitivity. The output of the thermocouple 150 is directed to the power and control circuitry 18 and can be used to help control the current flow to the induction coil 22.

It is desirable to be able to keep track of movement of the stick of can ends 14 through the dryer 10. If the can ends 14 are not moving, power to the induction coil 22 can be reduced or turned off completely. If the can ends 14 are moving, the induction coil 22 can be operated to heat and dry the can ends.

The laser sensor 120 is operative to sense the presence or absence of movement of a stick of can ends 14 through the inlet hub 60. The output of the sensor 120 is directed to the power and control circuitry 18. If the sensor 120 senses that the can ends 14 are moving into the dryer 10, the induction coil 22 can be operated to heat and dry the can ends. If, on the other hand, the sensor 120 senses that the stick of can ends is slowed or stopped, for example by a jam or by simply a lack of workpieces coming into the dryer 10, then the induction coil 22 can be controlled to reduce or eliminate current flow through the induction coil. Because the laser sensor 120 is a non-contact sensor, it is not affected by jams or out of position can ends 14 in a stick. In comparison to the prior art rotating wheel sensor, therefore, the laser sensor 120 of the present dryer 10 is a significant improvement.

Having described the invention, we claim:

1. An induction heating apparatus for heating can lid workpieces moving through said apparatus, comprising:

a housing;

a tube in said housing defining a generally enclosed space in said housing through which the workpieces travel as they move through said apparatus, said tube having an inlet end for receiving workpieces an outlet end for discharging workpieces; an inlet hub that is connected to said housing and that supports said tube inlet end, and an outlet hub that is connected to said housing and that supports said tube outlet end;

an induction coil for heating the workpieces as they move through said enclosed space;

an air inlet in said inlet hub for enabling air to flow into said enclosed space;

an air outlet in said outlet hub that is in fluid communication with a suction device for enabling air to be suctioned out of said enclosed space to the exterior of said housing; and a moveable stop member to block movement of said tube end out of engagement with one of said inlet hub and outlet hub, said stop member being moveable to a position which permits said tube to move out of engagement with said one of said inlet hub and outlet hub so that said tube can be removed from said housing.

2. An apparatus as set forth in claim 1 wherein said suction device comprises a suction fan connected with said air outlet and operative to draw air through said enclosed space.

3. An apparatus as set forth in claim 2 wherein said housing is pressurized with heated air from power and control circuitry associated with said induction coil.

4. An apparatus as set forth in claim 2 wherein said suction fan is located in the path of air flow from said air outlet and is operative to draw air out of said air outlet.

5. An apparatus as set forth in claim 3 further including a heater located inside said housing for heating air flowing into said tube through said inlet hub.

6. An apparatus as set forth in claim 1 wherein said inlet hub and said outlet hub are inside said housing.

7. An apparatus as set forth in claim 1 wherein said tube rests on said hubs and is retained thereon by gravity, said tube being removable from said hubs by lifting said tube upward from said hubs.

8. An apparatus as set forth in claim 7 comprising a movable stop member that prevents upward movement of said tube from said hubs, said tube being removable from said hubs after said stop member is moved to a position that permits said tube to be removed from said hubs.

9. An apparatus as set forth in claim 1 comprising a temperature sensor disposed at said outlet end of said tube, wherein workpieces contact said temperature sensor as they pass through said outlet end of said tube.

10. An apparatus as set forth in claim 1 comprising a non-contact motion sensor disposed near said tube inlet end.

11. An apparatus as set forth in claim 1 wherein said air inlet enables air to flow from said housing interior into said enclosed space.

12. An induction heating apparatus for heating workpieces, comprising:

housing; a tube in said housing defining a generally enclosed space in said housing through which the workpieces travel as they move through said apparatus;

an induction coil for heating the workpieces as they move through said apparatus;

an air inlet for enabling air to flow into said enclosed space;

an air outlet for enabling air to flow out of said enclosed space to the interior of said housing; and a heater adjacent said air inlet for heating air flowing into said air inlet and through said enclosed space;

said housing has opposite end walls for supporting said tube, each one of said end walls having a support member on which a respective end of said tube rests to block downward movement of said tube end, each one of said end walls having a movable stop member to block upward movement of said tube end, said tube being removable from said housing by lifting upward out of said housing when said stop member is in a position that permits said upward movement.

13. An induction heating apparatus for heating workpieces, comprising: a housing through which workpieces move as they are heated; a tube supported in said housing, said tube defining a passage through which workpieces move, said tube having around it an induction coil for heating the workpieces as they move through said tube, said housing having opposite end walls for supporting said tube; each one of said end walls having a support member on which a respective end of said tube rests to block downward movement of said tube end, further comprising a moveable stop member to block movement of said tube end out of engagement with one of said support members, said stop member being moveable to a position which permits said tube to move out of engagement with said support member so that said tube can be removed from said housing.

14. An induction heating apparatus as set forth in claim 13 wherein said housing has a part which when open enables removal of said tube from said housing.

15. An apparatus as set forth in claim 13 comprising two stop members to block movement of said tube ends out of engagement with their respective support members.

16. An apparatus as set forth in claim 15 wherein said each one of said stop members is a bolt that is threadably engaged with an end wall.

17. An apparatus as set forth in claim 13 wherein said tube ends have a circular configuration and said support members on said end wall have a semi-circular configuration that is concave upward.

18. An induction heating apparatus for heating workpieces, comprising:

a cabinet though which workpieces move as they are heated, said cabinet having a plurality of walls, said walls of said cabinet defining an opening of said cabinet;

a tube defining a passage though which workpieces move, said tube having around it an induction coil for heating the workpieces as they move though said tube, and a cover for said cabinet, said cover being movable between a closed position for closing said cabinet opening and an open position in which said opening of said cabinet is open to enable removal of said tube though said opening of said cabinet;

said tube having first and second ends that are supported by first and second hubs that are connected to said cabinet to block downward movement of said tube within said cabinet, and a stop member to block upward movement of said tube within said cabinet when said stop member is in a first position and said upward movement of said tube is enabled when said stop member is in a second position.

19. An apparatus as set forth in claim 18 wherein each one of said tube ends has a circular configuration and said hubs each have a semi-circular configuration that is concave upward.

20. An apparatus as set forth in claim 18 wherein said stop members are bolts.

* * * * *